United States Patent [19]

Denning

[11] 4,188,728

[45] Feb. 19, 1980

[54] VARIABLE INDEXING PEGS

[76] Inventor: LeRoy M. Denning, 5925 Creekview Dr., Clarence Center, N.Y. 14032

[21] Appl. No.: 808,465

[22] Filed: Jun. 21, 1977

[51] Int. Cl.[2] ..... B41B 1/00

[52] U.S. Cl. ..... 33/184.5

[58] Field of Search ..... 33/184.5

[56] References Cited

U.S. PATENT DOCUMENTS

| | | | |
|---|---|---|---|
| 2,226,302 | 12/1940 | Aswad | 33/184.5 |
| 2,760,273 | 8/1956 | Bregman | 33/184.5 |
| 2,776,594 | 1/1957 | Garity | 33/184.5 |
| 2,983,049 | 5/1961 | Andrisani | 33/184.5 |
| 3,695,760 | 10/1972 | Orr | 33/184.5 |

*Primary Examiner*—Willis Little

*Attorney, Agent, or Firm*—William J. Crossetta, Jr.

[57] ABSTRACT

A method and apparatus for accurately and variably positioning carrier indexing pins in indexing pegs for indexed registering devices useful in positioning an image, mask or transparency in a step and repeat type printing process.

20 Claims, 19 Drawing Figures

VARIABLE INDEXING PEGS

BACKGROUND OF THE INVENTION

In the graphic arts industry where rows and columns of images are to be prepared on a positive and/or negative image producing transparency, by stepping the image from position to position, a problem has been the cost and inconvenience of obtaining accurate indexing pegs useful in the registering process.

Briefly, the aforesaid registering process is one wherein a registering device, being essentially a templet having opposing parallel margins to which masks, transparencies, or images may be attached, and having marginal rows of indexed registering holes which are regularly and accurately spaced on opposing parallel margins, into which may be securely placed indexing pegs having carrier pins located so as to correspond to the distances between adjacent images in a row and between rows of images, said indexing pegs being adaptable to index a mask, image or transparency in increments of distance which may be less than the distance between indexed register holes in the registering device. With the indexing pegs in position, an image carrier or mask may be placed on the device by means of tabs or holes in said carrier or mask which mate with the upper carrier pin of the indexing peg. The indexing peg is then attached to the registering device, said peg being adapted to mate precisely with the indexed registering holes of the registering device by means of anchor register pins so that the device is prepared for step and repeat type printing along a registering strip having equally spaced register holes corresponding to the position of the anchor registering pins in the indexing peg. The image, mask or transparency may be stepped from position to position in rows along the indexed, register margin in the step and repeat type printing process to form rows of adjacent like images. U.S. Pat. No. 2,983,049 issued May 9, 1961, describes a typical registering device with indexing pegs to which the instant invention pertains.

SUMMARY OF THE INVENTION

The instant invention relates to a method and apparatus for the accurate preparation of indexing pegs.

A better understanding of the invention of the present application may be had from a reading of the following specification and inspection of the drawings as follows.

In FIGS. 1–10, indexing pegs are shown which are adopted to be placed in the holes of a registering device at positions corresponding to selected distances for preparation of a transparency, mask or image carrier for use in a step and repeat type printing process.

Figure 1:
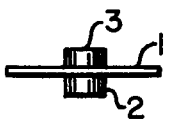
FIGS. 1, 3, 5, 7 and 9 depict side views of indexing pegs of the prior art.
Figure 2:
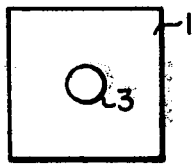
FIGS. 2, 4, 6, 8 and 10 depict top plan views of FIGS. 1, 3, 5, 7 and 9 respectively.
Figure 3:
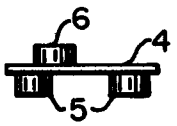
Figure 4:
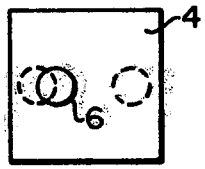
Figure 5:
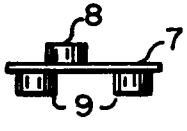
Figure 6:
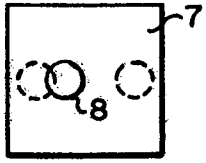
Figure 7:
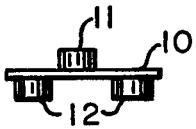
Figure 8:
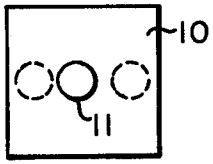

The indexing peg of FIGS. 1 and 2 includes a pin plate 1 to which is attached a lower anchor pin 2 for engaging in an indexing hole in the registering device, and an upper carrier pin 3 actually aligned with the lower pin for engaging an image or mask carrier. Indexing pegs of the type indicated in FIGS. 1 and 2 may be used in registering devices where the distance between images or rows of images falls in the exact location of one of the holes provided in the registering device, but are inappropriate for use when the distance between images or rows of images falls at increments other than those inherent in the registering device.

The indexing pegs of FIGS. 3–10 are especially designed for distances other than those which follow the location of the holes of the registering device. For example, the indexing peg of FIGS. 3 and 4 includes a pin plate 4 having a pair of lower anchor pins 5 which are spaced apart by a distance equal to or in multiples of the distance of adjacent holes of the registering device. Also attached to the pin plate 4 is an upper carrier pin 6 which is offset by a predetermined distance between pins 5. In like fashion, but by a different predetermined offset distance in each instance, the indexing peg of FIGS. 5 and 6 includes a pin plate 7 to which an offset carrier pin 8 and a pair of anchor pins 9 are attached; the indexing peg of FIGS. 7 and 8 includes a pin plate 10 to which an offset carrier pin 11 and a pair of anchor pins 12 are attached; and the indexing peg of FIGS. 9 and 10 includes a pin plate 13 to which an offset carrier pin 14 and a pair of anchor pins 15 are attached.

Figure 9:
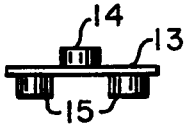
Figure 10:
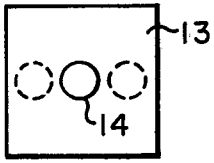

The indexing peg of FIGS. 1–2 may be used when the selected distance falls at one of the indexing holes of the registering device; the indexing peg of FIGS. 9–10 is used where the selected distance falls halfway between adjacent holes; and the indexing pegs of FIGS. 3–8 provide for other distances. It should be noted that each of the indexing pegs of FIGS. 3–8 may be used without modification for two separate distances by merely turning the peg 180°.

In typical embodiments, spacing between the center of the indexing holes of the registering device itself is normally ½" with the holes being ¼" in diameter, leaving ¼" of solid material between each pair of adjacent holes. With such spacing of holes, the indexing pegs may each include ¼" lower anchor pins, which in the case of pairs of pins on the offset pegs may be likewise spaced by ½" between centers and preferably 1" or longer, while the carrier pin 6 of the indexing peg of FIGS. 3–4 may be offset by 1/16"; the carrier pin 8 of the indexing peg of FIGS. 5–6 may be offset by ⅛"; the carrier pin 11 of the indexing peg of FIGS. 7–8 may be offset by 3/16"; and the carrier pin 14 of the indexing peg of FIGS. 9–10 may be offset by ¼". Thus, for the use of correct ones of the indexing pegs of FIGS. 3–10, a carrier pin may be provided which is located from an anchor pin in the registering device by any desired distance in accurate increments. In practice, a 1/64" increment has been found to be sufficiently small for the vast majority of cases. However, it will be appreciated that additional offset pegs may be provided for smaller increments of distance if required, and in any unit of measurement. It will also be appreciated that alignment of the anchor pins of the indexing peg need not be with adjacent registering holes of the registering device but may be in alignment with every other hole, third hole, fourth hole, or the like thereof. Such alignment may be desirable when the increment between carrier pin and anchor pin attachment of an adjacent hole arrangement is such as to unduly complicate or preclude pin attachment.

Figure 11:
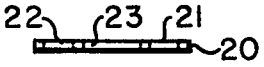
FIG. 11 is a side view of one type of indexing peg pin plate of the invention.
Figure 12:
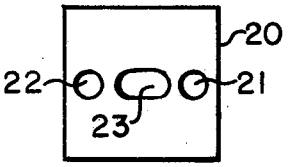
FIG. 12 is a plan view of the peg of FIG. 11.

The instant invention relates to a method and apparatus for the preparation of the aforesaid indexing pegs, which allows convenient and inexpensive construction of indexing pegs, by an operator of the step and repeat type printing process. Such apparatus and process precludes the necessity of maintaining large numbers of varying offset indexing pegs and the concomitant expense and bother thereof. In accord herewith, FIGS. 11 and 12 represent an indexing peg having a pin plate 20 provided with anchor registering holes 21 and 22 and variable offset carrier pin hole 23. The pin plate may be inexpensively and easily manufactured with accurately placed anchor registering and variable offset holes for ready availability to the step and repeat printing process operator. The size and shape of the anchor registering hole is such as to accept pins of proper size and shape for the registering device being utilized and need not be the same size as the carrier pin. The distance between said anchor holes may be any convenient distance, but must be such distance which will allow both anchor registering pins to be accurately and securely placed in corresponding adjacent or other holes of the registering device. The variable offset carrier pin hole must be of sufficient width and length so as to securely accept the desired offset carrier pin along its entire length, such that said carrier pin can be inserted in said variable carrier pin hole accurately and securely at any desired offset or other distance between the anchor registering pin holes.

Figure 13:
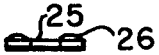
FIG. 13 is a side view of one type of attachment mark for use of the invention.
Figure 14:
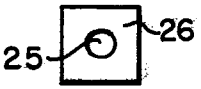
FIG. 14 is a plan view of the attachment mark of FIG. 13.
Figure 15:
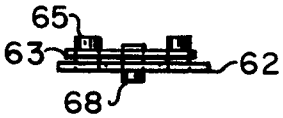
FIG. 15 is a side view of one type of variably offset indexing peg of the invention.
Figure 16:
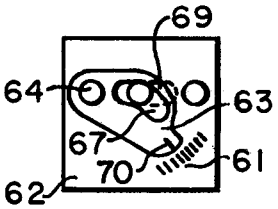
FIG. 16 is a plan view of the indexing peg of FIG. 15.

Attachment of said variable carrier pin may be achieved by any convenient method including mechanical means such as riveting, press fitting, screw fitting and the like. However, an especially convenient method is be removable adhesive mounting such as can be achieved by utilizing the attachment mark of FIGS. 13 and 14 having a carrier pin hole 25, corresponding in size and shape to the carrier pin utilized, which attachment mark has pressure sensitive adhesive 26 on the attachment side thereof, thereby allowing it to secure the variable carrier pin at any desirable offset or equal position within the variable offset carrier pin hole of the indexing peg. It should be understood that the attachment mark may have only a portion of the attachment side containing adhesive and also may not have adhesive thereon but be attachable by utilizing separate attaching means. FIGS. 15 and 16 represent a variable offset indexing peg having as an integral part thereof an offset carrier peg increment scale 61 which allows the operator to pre-set the desired offset increment without reverting to added equipment. In this configuration pin plate 62 is provided with an increment scale 61 and indexing plate 63 is provided with pivot hole 64 which is permanently or removably attached at anchor register pin 65. Variable arc hole 67 is provided in indexing plate 63 and is so arranged that movement of carrier pin 68 through the variable offset carrier pin hole 69 of pin plate 62, will cause the index pointer 70 of indexing plate 63 to move through the arc of increment scale 61 enabling the operator to select increments corresponding to pre-established points in the increment scale.

The indexing pegs of this invention may be made of any suitable material. Typically, the pin plate is made of a flexible but resilient material such as a suitable plastic, cellulosic, coated cellulosic, layered or metallic material. A preferred material is a resilient plastic. The anchor pins and carrier pins may also be made of any suitable material such as plastic or metal, the preferred materials being brass, aluminum, stainless steel or plastic.

The method useful for accurately establishing a variable offset pin position within the variable offset carrier pin hole comprises the steps of establishing the distance between permanent registering holes on the indexing peg such as to correspond with selected indexing holes of the registering device, and thereafter attaching the variable offset carrier pin at a point within the variable offset carrier pin hole corresponding to the desired distance between registering holes.

Figure 17:
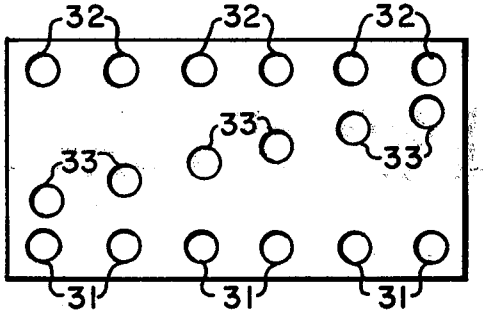
FIG. 17 is a plan view of one type of offset template useful with the invention.

Typical apparatuses which may be used to accurately obtain desired offset distances include templets such as described in FIG. 17 wherein holes 31 and 32 correspond to selected increments in indexing holes of a selected registering device and wherein multiple holes 33 correspond to varying offset increments. In such instance, anchor registering pins of a variable offset indexing peg, which correspond in distance therebetween to the distance between holes 31 and 32, may be inserted in said holes respectively, whereby attachment of a variable offset carrier pin may be achieved by attaching said pin in the desired offset distance corresponding to variable offset holes 33.

Figure 18:
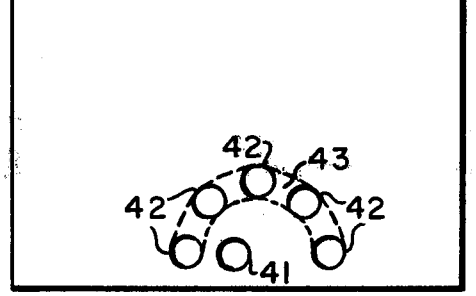
FIG. 18 is a plan view of another type of offset template useful with the invention.

A further apparatus useful in the practice of this invention is described in FIG. 18, comprising anchor registering pin hole 41 which receives an anchor registering pin from the variable offset indexing peg. Variable offset holes 42 are arranged in an arcing configuration varying in distance from anchor registering pin hole 41 such that movement of the variable offset indexing peg along the arc will allow placement of the variable offset carrier pin at the appropriate corresponding distance. Similarly, holes 42 may be merged to form an arched slot 43 wherein sweeping of the variable offset indexing peg through the arc will allow movement of said variable offset carrier pin within said variable offset carrier pin hole of the indexing peg such that predetermined points in said arc will provide accurate measured placement of the variable offset carrier pin in the indexing peg. It should be understood that such arching configuration includes a full circle arc.

Figure 19:
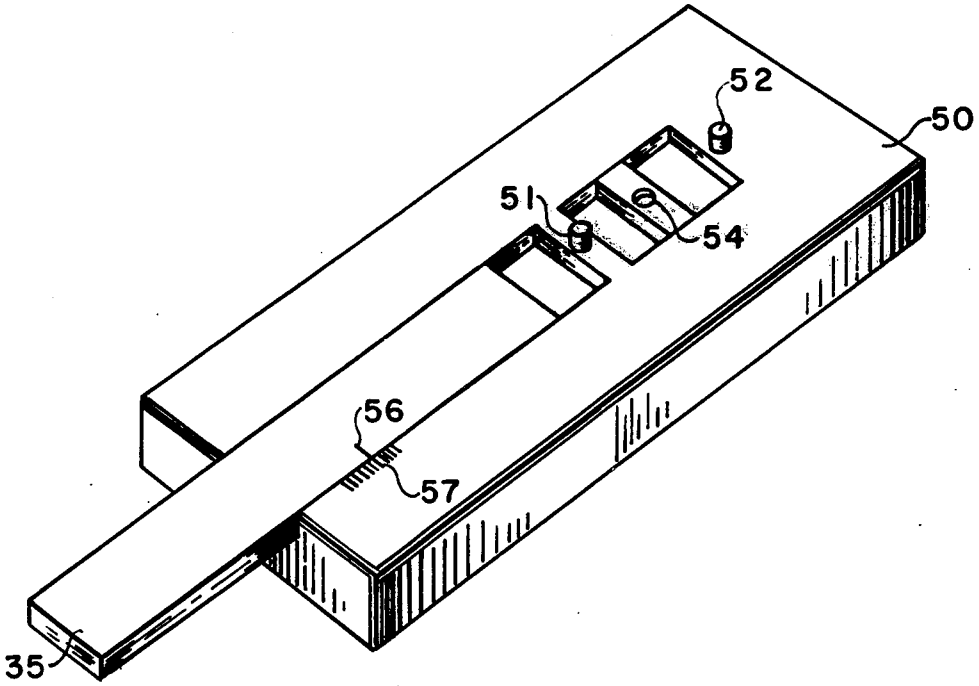
FIG. 19 depicts a slide-adjusting offset template device useful with the invention.

Similarly, FIG. 19 represents a slide-adjusting device 50 having anchor registering pins 51 and 52 adapted to mate at the appropriate anchor registering pin position of the pin plate of the variable offset indexing peg such that alignment of said pin plate of the variable offset indexing peg with said anchor registering pins of the adjusting device allows the operator to slidably adjust the variable offset carrier pin holder hole 54 by means of carrier slide 55 to a predetermined distance wherein index mark 56 aligns with scale 57 and accordingly to attach a carrier pin to the variable offset indexing peg at the desired distance. It should be understood that instead of a scale, a templet may be provided which sets the desired distances between the anchor pin and the carrier pin. The advantages of the process and apparatus of the instant invention are not solely derived from the provision of presettable registering pin. As constructed, the registering pegs are useful devices for layout and alignment work wherein there is required a high degree of accuracy and consistency with ease and convenience to the operator.

I claim:

1. A method for accurately and variably positioning an indexing carrier pin in an indexing peg for indexed registering devices comprising forming a variable indexing peg with anchor pins thereon corresponding in size, shape and distance therebetween to selected indexing holes of an indexed registering device, providing a slotted opening in said indexing peg, between said anchor pins of such size and shape as to allow attachment of an indexing carrier pin at any variable position along the length of said slot and attaching said carrier pin at a point along the length of said slot.

2. The method of claim 1 wherein said anchor pins are removably attached to said indexing peg.

3. The method of claim 1 wherein said carrier pin is removably attached to said indexing peg.

4. The method of claim 1 wherein said carrier pin is attached by a removable adhesive attachment mark.

5. The method of claim 1 wherein said variable position along the length of said slot is determined by comparison with a template device.

6. A variable indexing peg for an indexed registering device comprising a pin plate with anchor pin registering holes corresponding in size, shape and distance therebetween to selected indexing holes of said indexed registering device, having extending through at least one of said registering holes an anchor pin adapted for removable insertion in at least one indexing hole of said indexed registering device, a carrier pin, means for attaching said carrier pin to the pin plate, said pin plate having a slotted opening between said anchor registering holes of such size and shape to allow the attachment of said carrier pin at any position along the length of said slot.

7. The variable indexing peg of claim 6 wherein said slotted opening extends through at least one anchor registering hole.

8. The variable indexing peg of claim 6 wherein said slotted opening extends through a portion of the distance between said anchor registering holes.

9. The variable indexing peg of claim 6 wherein the anchor registering holes are circular and the width of said slot corresponds to the diameter of said anchor registering holes.

10. The variable indexing peg of claim 6 wherein said anchor registering holes are of different size and shape from the indexing holes of the registering device.

11. The variable indexing peg of claim 6 wherein said pin plate is plastic.

12. The variable indexing peg of claim 6 wherein said pin plate is metal.

13. The variable indexing peg of claim 6 having an indexing plate, with a variable arc slot, pivotably attached, at one registering hole of the indexing peg, said variable arc slot so arranged as to overlay, during pivotal movement of the indexing plate, varying positions in the slotted opening of the pin plate.

14. The variable indexing peg of claim 13 wherein at least one of said indexing plate and said pin plate has an increment scale means denoting varying overlay positions of the variable arc slot through the slotted opening of the pin plate.

15. The variable indexing peg of claim 6 wherein said anchor registering pin is removably attached.

16. The variable indexing peg of claim 6 having an indexing carrier pin attached at a position within said slotted opening.

17. The variable indexing peg of claim 16 wherein said attached indexing carrier pin is attached by a removable adhesive attachment mark.

18. A variable indexing peg for an indexed registering device comprising a pin plate with two anchor registering pins extending from registering holes in said plate, from a common side of said plate, corresponding in distance therebetween to selected indexing holes of said indexed registering device, and adapted for removable insertion in said selected indexing holes of said indexed registering device, a carrier pin, means for attaching said carrier pin to the pin plate, said pin plate having a slotted opening between said anchor registering pins adapted to allow the attachment of said carrier pin at any position along the length of said slot.

19. The variable indexing peg of claim 18 wherein at least one of said anchor pins is removably attached.

20. The variable indexing peg of claim 19 wherein said carrier pin is slidably attached to said pin plate.

* * * * *